US009339125B1

(12) United States Patent
Floersch et al.

(10) Patent No.: US 9,339,125 B1
(45) Date of Patent: May 17, 2016

(54) DISPLAY FIXTURE WITH TETHER AND CROSS BAR

(71) Applicant: Target Brands, Inc., Minneapolis, MN (US)

(72) Inventors: David J. Floersch, Minneapolis, MN (US); Blake M. Johnson, St. Paul, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/675,866

(22) Filed: Apr. 1, 2015

(51) Int. Cl.
*A47F 3/00* (2006.01)
*A47F 5/00* (2006.01)
*A47B 47/00* (2006.01)

(52) U.S. Cl.
CPC ..... *A47F 3/002* (2013.01); *A47B 47/00* (2013.01); *A47F 5/0018* (2013.01)

(58) Field of Classification Search
CPC ..... A47B 57/06; A47B 57/16; A47B 57/20; A47B 57/30; A47B 57/40; A47B 57/406; A47B 57/42; A47B 57/408; A47B 47/00; A47B 47/02; A47B 47/021; A47B 47/022; A47B 47/027; A47F 5/101; A47F 5/103; A47F 5/0018; A47F 5/10; E05B 73/00; Y10T 24/1397
USPC ..... 211/204, 206, 193, 190, 187, 4, 7, 211/119.003; 340/568.1
See application file for complete search history.

(56) References Cited

U.S. PATENT DOCUMENTS

| | | | | |
|---|---|---|---|---|
| 883,335 | A | 3/1908 | O'Connor | |
| 3,561,714 | A * | 2/1971 | Zurawski | A47B 96/07 108/108 |
| 3,871,525 | A * | 3/1975 | Al-Dabbagh | A47B 57/402 211/182 |
| 3,985,183 | A | 10/1976 | Fernbaugh | |
| 4,460,093 | A | 7/1984 | Otema | |
| 4,874,148 | A * | 10/1989 | Guinter | A47B 96/067 248/220.22 |
| 5,016,758 | A | 5/1991 | Ward | |
| 5,124,685 | A * | 6/1992 | Rankin | G08B 13/1463 200/61.13 |
| 5,154,072 | A * | 10/1992 | Leyden | E05B 69/006 211/4 |
| 5,577,855 | A | 11/1996 | Leyden et al. | |
| 5,797,487 | A * | 8/1998 | Young | G11B 33/0405 206/307 |
| 6,659,382 | B2 | 12/2003 | Ryczek | |
| 7,135,972 | B2 | 11/2006 | Bonato | |
| 7,202,786 | B2 | 4/2007 | Marszalek et al. | |

(Continued)

*Primary Examiner* — Brian Glessner
*Assistant Examiner* — Paola Agudelo
(74) *Attorney, Agent, or Firm* — Leanne Taveggia Farrell; Westman, Champlin & Koehler, P.A.

(57) ABSTRACT

A display fixture includes a shelf and a cross bar positioned below the shelf by a distance and having an interior channel and a slot. A fence is mounted to a top of the shelf and located proximal to a front of the shelf. A winder assembly includes a winder mechanism located inside the interior channel of the cross bar and a retractable tether coupled to the winder mechanism and having a distal end. The retractable tether extends through the slot in the cross bar and around a back of the shelf, is attached to product resting on the shelf and the distal end of the retractable tether is locked to the fence.

20 Claims, 6 Drawing Sheets

(56) References Cited

U.S. PATENT DOCUMENTS

| | | | | |
|---|---|---|---|---|
| 7,438,268 | B2 | 10/2008 | Kologe | |
| 8,038,021 | B2 * | 10/2011 | Chen | A47B 46/005 211/187 |
| 8,281,624 | B2 * | 10/2012 | Rizzi | E05B 73/0017 211/7 |
| 8,528,752 | B2 | 9/2013 | Bowser et al. | |
| 8,558,688 | B2 * | 10/2013 | Henson | G06F 1/1626 340/539.1 |
| 8,963,498 | B2 * | 2/2015 | Ferguson | B65H 75/48 320/107 |
| 2005/0231365 | A1 * | 10/2005 | Tester | G06K 19/07798 340/568.1 |
| 2007/0023557 | A1 * | 2/2007 | Rankin | A45F 5/004 242/381 |
| 2009/0058643 | A1 * | 3/2009 | Groth | G08B 13/128 340/568.1 |
| 2012/0280810 | A1 * | 11/2012 | Wheeler | G08B 13/1445 340/539.11 |

* cited by examiner

DISPLAY FIXTURE WITH TETHER AND CROSS BAR

BACKGROUND

A retail establishment uses various types of display units or shelving units to store, organize or present products to customers for purchase. One kind of display unit is a gondola. Gondola display units are constructed of, but are not limited to, uprights, back panels, base decks and shelves.

Certain products, especially electronics, are susceptible to being stolen and are often displayed behind locked glass doors where a customer cannot freely access the item to inspect. One alternative to glass enclosed shelves is to display products wrapped in a theft protection device so they can be left out on a shelf for customer interaction. However, in some situations, even when wrapped in a theft protection device, a person could take the product out of the store sounding the alarm, but not be apprehended.

The discussion above is merely provided for general background information and is not intended to be used as an aid in determining the scope of the claimed subject matter.

SUMMARY

A display fixture includes a shelf, a cross bar positioned below the shelf by a distance, a fence and a winder assembly. The cross bar has an interior channel and a slot. The fence is mounted to a top of the shelf and is located proximal to a front of the shelf. The winder assembly includes a winder mechanism located inside the interior channel of the cross bar and a retractable tether coupled to the winder mechanism and having a distal end. The retractable tether extends through the slot in the cross bar and around a back of the shelf, is attached to product resting on the shelf and the distal end of the retractable tether is locked to the fence.

A display fixture includes a gondola, a shelf, a cross support, a fence and a retractable tether. The gondola has a base deck and a back panel supported by a pair of slotted uprights. The shelf is mounted to the pair of slotted uprights. The cross support is positioned under the shelf and mounted to the pair of slotted uprights. The fence is coupled to a top of the shelf and positioned proximal to the front of the shelf. The retractable tether is coupled to a winder mechanism located inside an interior channel in the cross support. The retractable tether extends from the winder mechanism through a slot in the cross support, extends between the back panel of the gondola and a back of the at least one shelf, couples to at least one product, and is secured to the fence at a distal end of the retractable tether with a lock so that the at least one product is secured to the shelf but is still allowed to be lifted and inspected by a customer.

A method of securing product to a display fixture in a retail store is described. A retractable tether is pulled from a winder mechanism located inside a cross bar positioned below a shelf on a display fixture so that the tether extends around a back of the shelf. The retractable tether is coupled to at least one product on the shelf. The retractable tether is coupled to a fence mounted to a top of the shelf and is located proximal to a front of the shelf. A distal end of the retractable tether is locked to the fence with a lock.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The display fixture described herein allows merchandise, such as merchandise wrapped in a theft protection device, to be tethered to a display shelf so that the merchandise is secured to the shelf, but still accessible to the customer for inspection. The display fixture includes a display shelf, a cross bar positioned below the shelf, a fence mounted to a top of the display shelf and proximal to a front of the display shelf and a retractable tether secured to the cross bar at one end and secured to the fence at an opposing end with a lock.

Figure 1:
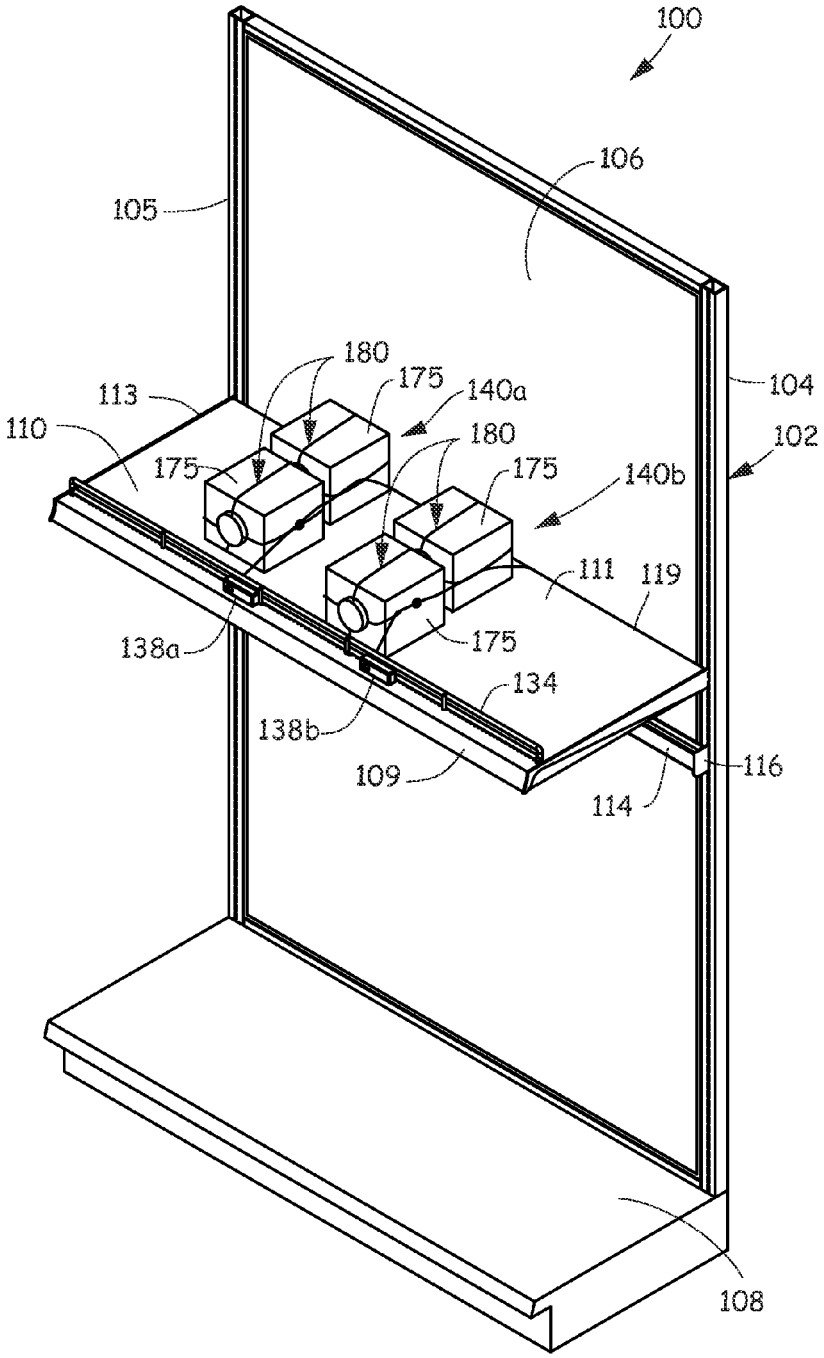
FIG. 1 is a perspective view of a display fixture according to one embodiment.
Figure 2:
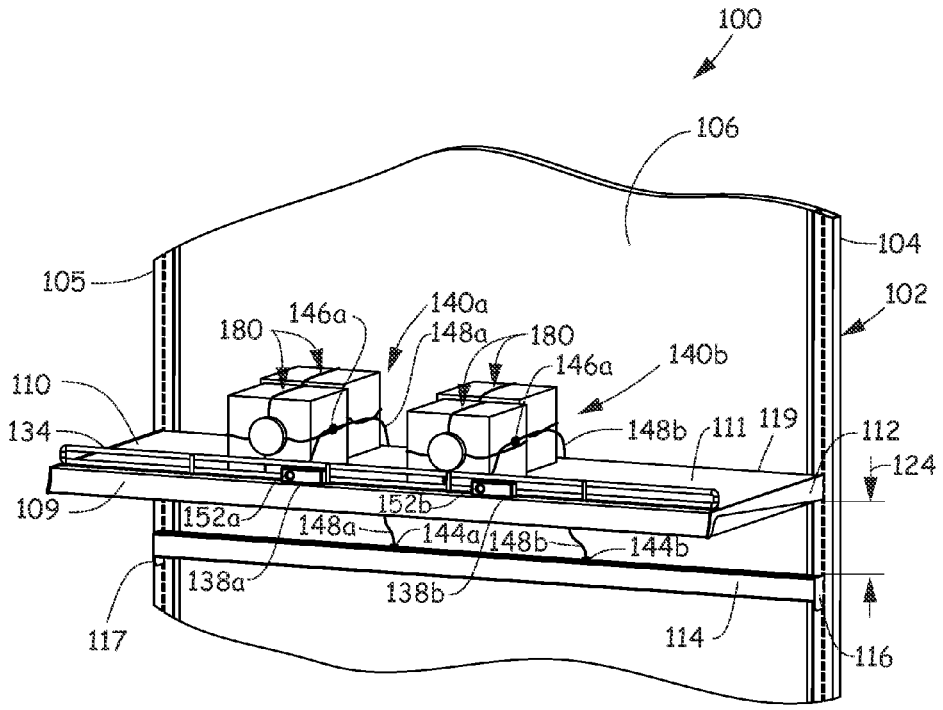
FIG. 2 is a perspective view of a portion of the display fixture illustrated in FIG. 1.

FIG. 1 is a perspective view of a display fixture 100 according to one embodiment. FIG. 2 is a perspective view of a portion of display fixture 100. In one embodiment, display fixture 100 includes a gondola 102. A gondola is a freestanding display unit used to display products and merchandise. Gondola 102 includes a substantially horizontal base deck 108 and a substantially vertical wall or back panel 106 supported by a pair of slotted uprights 104 and 105. Gondolas placed side-by-side form rows that define aisles in a retail store. Mounted to the slotted uprights 104 and 105 is at least one shelf 110. As illustrated, the uprights 104 and 105 receive brackets 112 and 113 of shelf 110 to support shelf 110 in a cantilevered configuration.

Also mounted to uprights 104 and 105 is a cross bar 114 that is positioned under or below shelf 110 and is spaced a distance 124 from shelf 110. As illustrated, uprights 104 and 105 receive brackets 116 and 117 of cross bar 114 to support cross bar 114 in a cantilevered configuration. Still further, display fixture 100 includes a fence 134 coupled to or mounted to a top 111 of shelf 110 and located or positioned proximal to a front 109 of shelf 110.

Figure 3:
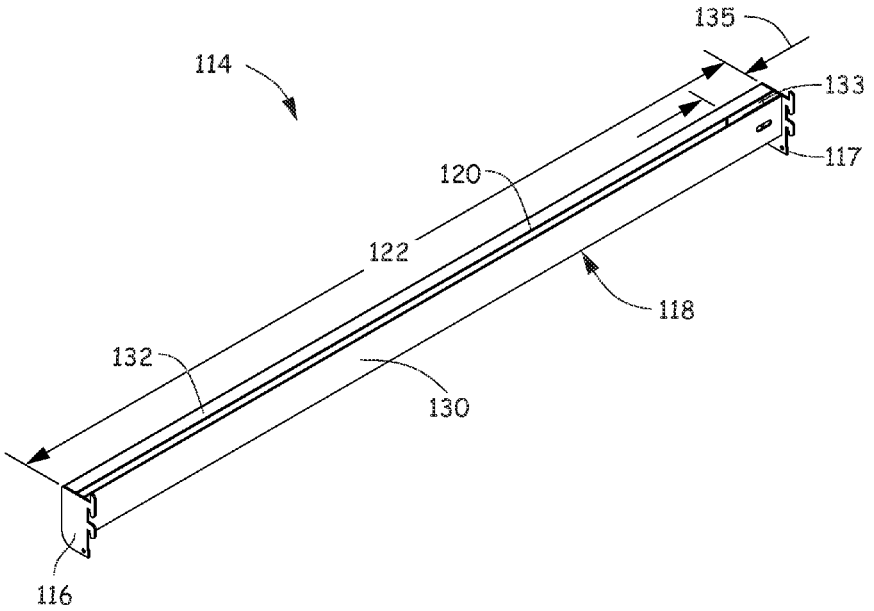
FIG. 3 is a back perspective view of a cross bar illustrated in FIGS. 1 and 2.
Figure 4:
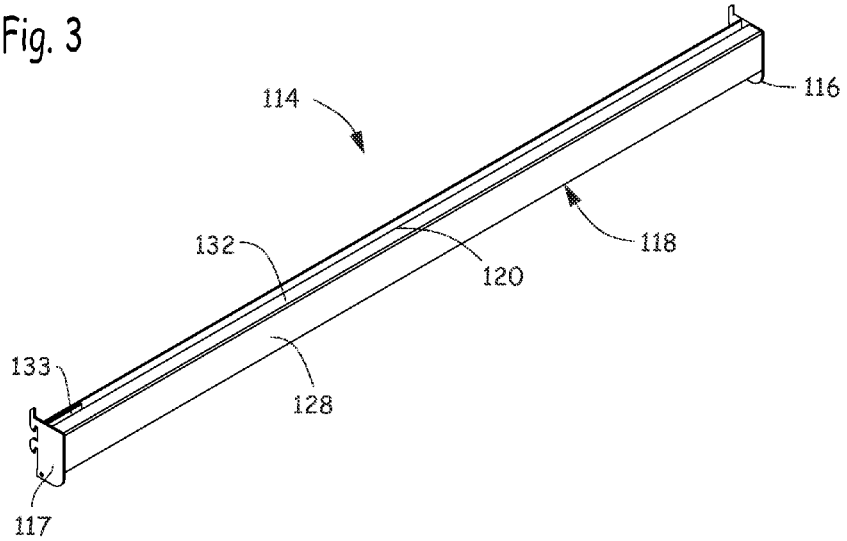
FIG. 4 is a front perspective view of the cross bar illustrated in FIG. 3.
Figure 5:
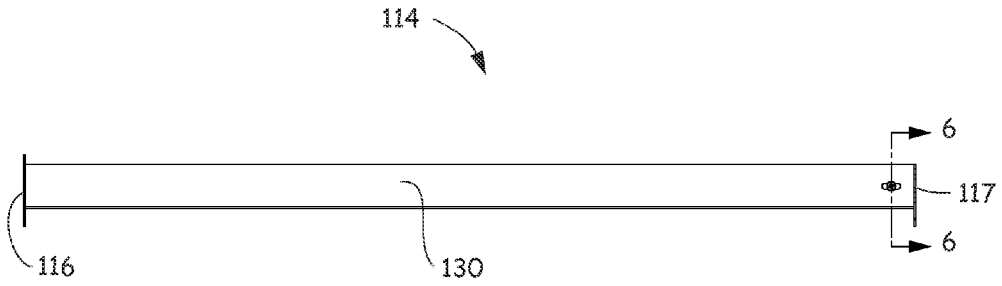
FIG. 5 is a back view of the cross bar illustrated in FIG. 3.
Figure 6:
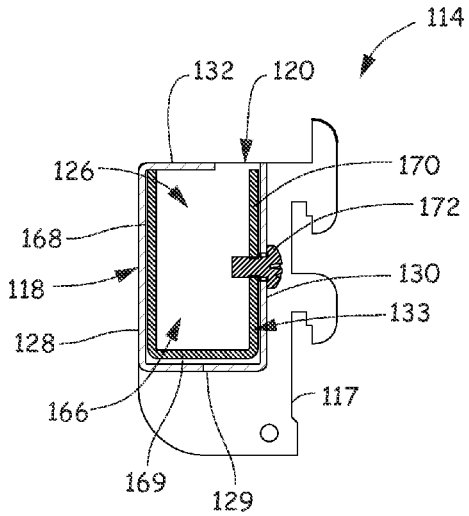
FIG. 6 is an enlarged section view of the cross bar illustrated in FIG. 3 taken through the line indicated in FIG. 5.

FIG. 3 is a back perspective view of cross bar or cross support 114 and FIG. 4 is a front perspective view of cross bar 114. FIG. 5 is a back view of cross bar 114 and FIG. 6 is an enlarged section view of cross bar 114 taken through the line indicated in FIG. 6. As illustrated, cross bar 114 includes an elongated member 118 having a first end that is attached to bracket 116 and a second end. Elongated member 118 is a hollow member having an interior channel 126 that is defined by a front side 128, a bottom 129, a back side 130, a top 132 and an elongated slot 120 located through top 132. Elongated slot 120 extends for a length 122 of elongated member 118. Cross bar 114 further includes a telescopic member 133 having a first end attached to bracket 117 and a second end. Telescopic member 133 is also a hollow member having an interior channel 166 that is defined by a front side 168, a bottom 169, a back side 170 and an open top.

Telescopic member 133 is slidably inserted into channel 126 so that front side 168 of telescopic member 133 is adjacent to front side 128 of elongated member 118, bottom 169 of telescopic member 133 is adjacent to bottom 129 of elongated member 118 and back 170 of telescopic member 133 is adjacent to back 130 of elongated member 118. Telescopic member 133 extends for a length 135 that is shorter than length 122 of elongated member 118 and is adjustable relative to elongated member 118 using fastener 172. Telescopic member 133 allows cross bar 114 to be as short as length 122 of elongated member 118 or to be longer using a portion of length 135 of telescopic member 133. Therefore, cross bar 114 has an adjustable length so cross bar 114 can be mounted to different gondolas that have different distances between upright 104 and 105. As previously described, bracket 116 is inserted into upright 104 and bracket 117 is inserted into upright 105 and the entirety of cross bar 114 is positioned below or under shelf 110 by a distance 124 (see FIG. 2).

Figure 7:
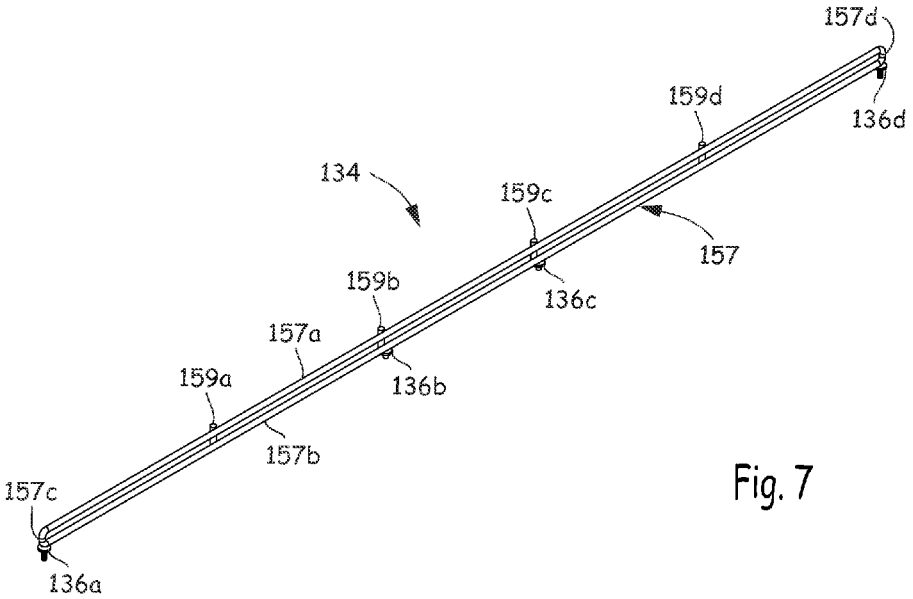
FIG. 7 is a perspective view of a fence of the display fixture illustrated in FIGS. 1 and 2.
Figure 8:
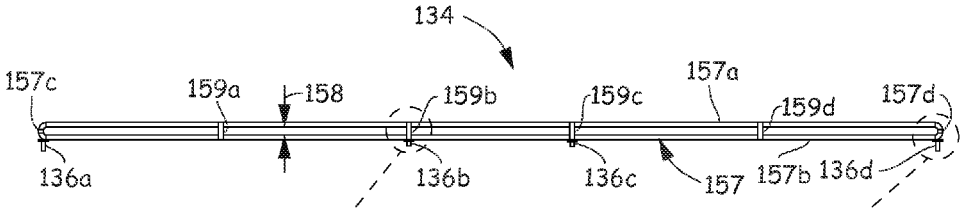
FIG. 8 is front view of the fence in FIG. 7.

FIG. 7 is a perspective view of fence 134 and FIG. 8 is a front view of fence 134. As previously discussed, fence 134 is mounted to top 111 of shelf 110 and located or positioned proximal to front 109 of shelf 110. Fence 134 includes a plurality of substantially horizontally-oriented and substantially vertically-oriented members. In the embodiment illustrated in FIGS. 7 and 8, fence 134 includes a single, continuous member 157 having an upper portion 157*a* that is substantially horizontally-oriented and a lower portion 157*b* that is substantially horizontally-oriented. Portions 157*a* and 157*b* are connected at their ends by curved portions 157*c* and 157*d* and are separated from each other by a space 158. Also in the embodiment illustrated in FIGS. 7 and 8, fence 134 includes a plurality of substantially vertically-oriented members 159*a*, 159*b*, 159*c* and 159*d* that connect upper portion 157*a* to lower portion 157*b* of member 157. Fence 134 also includes a plurality of downwardly depending pins 136*a*, 136*b*, 136*c* and 136*d*. Pins 136*a* and 136*d* depend downwardly from curved portions 157*c* and 157*d* of member 157 and pins 136*b* and 136*c* depend downwardly from vertical members 159*b* and 159*c*. Although fence 134 has four downwardly depending pins 136*a-d*, it should be realized that fence can include any number of downwardly depending pins.

Figure 9:
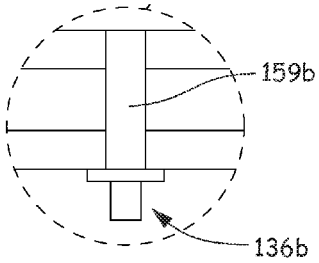
FIG. 9 is an enlarged front view of a portion of the fence in FIG. 7.
Figure 10:
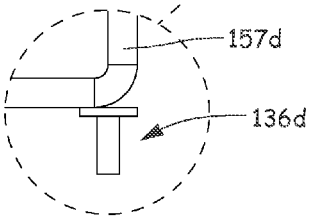
FIG. 10 is an enlarged front view of another portion of the fence in FIG. 7.

FIG. 9 illustrates an enlarged front view of pin 136*b* and FIG. 10 illustrates an enlarged front view of pin 136*d*. Pins 136*a-d* are inserted through perforations that extend through shelf 110 from top 111 to a bottom and are located proximal to front 109 of shelf 110. In the illustrated embodiment, center pins 136*b* and 136*c* are used to accurately position fence 134 on shelf 110, while end pins 136*a* and 136*d* are used to securely mount fence 134 to shelf 110 with hardware (not shown), such as wing nuts. Fence 134 serves at least two purposes. First, fence 134 prevents product from falling off the front of shelf 110. Second, fence 134 provides a structure for a retractable tether to be locked to using locks, such as locks 138*a* and 138*b* illustrated in FIGS. 1 and 2. Locks 138*a* and 138 will be described in detail below.

Figure 11:
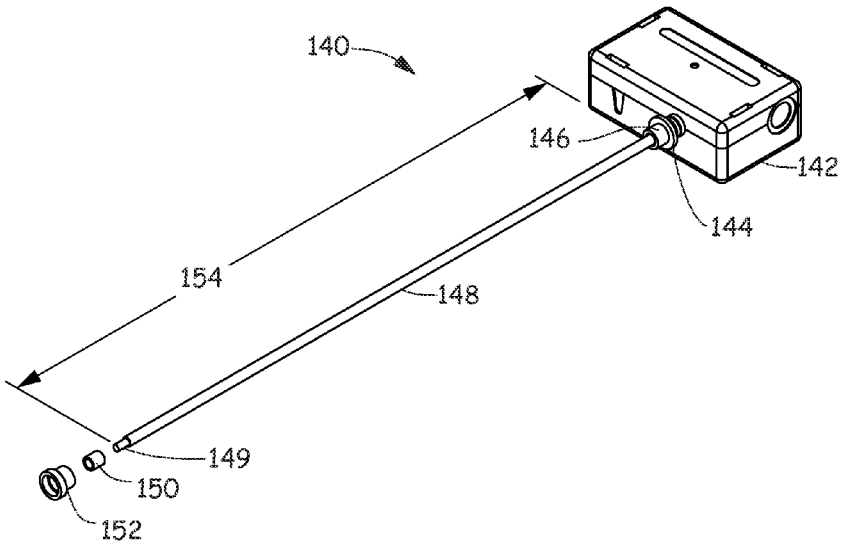
FIG. 11 is an enlarged exploded view of a winder assembly for securing the theft protected package to a shelf.

FIG. 11 illustrates an exploded perspective view of a winder assembly 140 for securing at least one product to shelf 110. In FIGS. 1 and 2, display fixture 100 includes winder assemblies 140*a* and 140*b*. In FIG. 11, winder assembly 140 includes a winder mechanism 142, a stop 144, a first collar 146, a tether 148 having a distal end 149, a second collar 150 and an end piece 152. Inside winder mechanism 142, tether 148 is spooled and there is a spring for automatically retracting tether 148 back into winder mechanism 142. Exemplary winder mechanisms can be those provided by Sennco Solutions Inc of Plainfield, Ill.

Winder assembly 140 further includes stop 144 and first collar 146. Stop 144 surrounds or encircles retractable tether 148 and floats along tether 148. Stop 144 includes a dimension that is greater than a width of slot 120 in elongated member 118 so that stop 144, as it floats along tether 148, is prevented from being located inside interior channel 126 of cross bar 114. Fixed first collar 146, on the other hand, is fixed to tether 148 at a specific location. Fixed first collar 146 and floating stop 144 engage to prevent retractable tether 148 from fully retracting into winder mechanism 142 located in cross bar 114. As illustrated in FIG. 11, a length 154 of retractable tether 148 is shown as protruding from winder mechanism 142. Length 154 is the distance between the location of fixed first collar 146 and distal end 149 of retractable tether 148. It is the minimum length to which retractable tether 148 will protrude from winder mechanism 142. More specifically, fixed first collar 146 engages with stop 144 and prevents retractable tether 148 from further retracting into winder mechanism 142. Second collar 150 and end piece 152 are both fixed to a distal end 153 of retractable tether 148 and are configured to engage with a lock.

With reference back to FIGS. 1 and 2, display fixture includes at least two winder assemblies 140*a* and 140*b*. However, any number of winder assemblies can be located inside interior channel 126 in display fixture 100 including a single winder assembly or more than two. Each winder assembly 140*a* and 140*b* includes a winder mechanism (not shown in FIGS. 1 and 2) that is housed in interior channel 126 of elongated member 118 before elongated member 118 is assembled to telescopic member 133 to form cross bar 114. With winder mechanisms located inside cross bar 114, stops 144*a* and 144*b* engage with fixed first collars 146*a* and 146*b* so that minimum length 154 of retractable tethers 148*a* or 148*b* protrude from each winder mechanism. Length 154 extends from slot 120 in cross bar 114 and around a back 119 of shelf 110 (i.e., between back panel 106 and back 119 of shelf 110). Therefore, minimum length 154 is greater than the distance between cross bar 114 and shelf 110. In other words, minimum length 154 must be long enough to extend above shelf 110. This ensures that personnel setting the shelf with product will never have to rethread tether 148 around the back side of shelf 110 because retractable tether 148 will be located above the back side of shelf 110.

As most clearly illustrated in FIG. 2, each retractable tether 148*a* and 148*b* is pulled from the back side of shelf 110 and from their respective winder mechanisms located inside cross bar 114. Because first collar 146 is fixed to retractable tethers 148*a* and 148*b*, the space between back panel 106 and back of shelf 110 must be large enough to accommodate the size of first collar 146 so that when retractable tether 148*a* and 148*b* are pulled, first collar 146 passes around the back of shelf 110.

Each retractable tether 148*a* and 148*b* is then coupled to products 175 that are resting on shelf 110. In FIGS. 1 and 2, each retractable tether 148*a* and 148*b* is coupled to a product 175 resting on shelf 110 by being threaded through a cable that is part of a theft protection device 180 that wraps around product 175. However, it is possible for retractable tethers 148*a* and 148*b* to be attached to the products resting on shelf 110 in other ways. For example, packaging of the product may include eyelets or holes to which retractable tethers 148*a* and 148*b* could be threaded through. Further, each retractable tether 148*a* and 148*b* is also threaded through fence 134. Second collar (not shown in FIGS. 1 and 2) and end pieces 152*a* and 152*b* located on distal ends of retractable tethers 148*a* and 148*b* are engaged with locks 138*a* and 138*b*, respectively, or locks 138*a* and 138*b* grip end pieces 152*a* and 152*b*. In this way, products 175 are secured to shelf 110, but are still allowed to be lifted and inspected by a customer.

Locks 138*a* and 138*b* require a key for both securely engaging the second collars and end pieces of tethers 148*a* and 148*b*, but also the same key is required to unlock the second collars and end pieces of tethers 148*a* and 148*b* from locks 138*a* and 138*b*. The key is kept by in store associates or personnel working on the floor. Exemplary locks can be those provided by Invue Security Products, Inc of Charlotte, N.C.

More specifically and as illustrated in FIGS. 1 and 2, locks 138*a* and 138*b* have dimensions that are greater than space 158 in fence 134. Thereby locking distal end 149 (FIG. 11) of retractable tethers 148*a* and 148*b* to fence 134 includes threading retractable tethers 148*a* and 148*b* through space 158 and therefore between portions 157*a* and 157*b* and placing locks 138*a* and 138*b* in front of fence 134.

Display fixture 100 includes retractable tethers secure products to a shelf. The retractable tethers protrude from winder mechanisms stored in a cross bar located below the shelf. Display fixture 100 provides a system that eliminates cumbersome cords or cables being used. It provides an easy, no-hassle way for in-store personnel to unlock and lock products when needed and also allows customer to easily lift and inspect products.

Although not illustrated in FIGS. 1 and 2, gondola 102 can also include a plurality of shelves 110 mounted to pair of slotted uprights 104 and 105. Each shelf 110 would have an associated cross bar 114 also mounted to upright 104 and 105 and be located below each shelf. Each cross bar 114 would have one or more winder mechanisms 142 having a retractable tether 148.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:
- a shelf;
- a cross bar positioned below the shelf by a distance and including an interior channel and a slot;
- a fence mounted to a top of the shelf and located proximal to a front of the shelf; and
- a winder assembly comprising:
  - a winder mechanism located inside the interior channel of the cross bar;
  - a retractable tether coupled to the winder mechanism and having a distal end; and
- wherein the retractable tether extends through the slot in the cross bar and around a back of the shelf, is attached to product resting on the shelf and the distal end of the retractable tether is locked to the fence with a lock.

2. The display fixture of claim 1, wherein the winder assembly further comprises a collar and a stop, wherein the collar is fixed to the retractable tether and the stop surrounds the retractable tether and has a dimension that is larger than a dimension of the slot in the cross bar.

3. The display fixture of claim 2, wherein the collar is fixed to the retractable tether at a location so that when the collar engages with the stop a length of retractable tether protrudes from the winder mechanism.

4. The display fixture of claim 3, wherein the length of retractable tether that protrudes corresponds with a distance between the fixed collar and the distal end of the retractable tether and is greater than the distance between the cross bar and the shelf.

5. The display fixture of claim 1, wherein the retractable tether comprises an end piece that is fixed to the distal end of the retractable tether and engages with the lock.

6. The display fixture of claim 1, wherein the cross bar comprises an elongated member having the slot and a telescopic member that fits inside the elongated member so that a length of the cross bar is adjustable.

7. The display fixture of claim 1, wherein the shelf and the cross bar are mounted to a pair of slotted uprights of a gondola using brackets.

8. The display fixture of claim 1, wherein the lock securely attaches and detaches from the distal end of the retractable tether with a key.

9. The display fixture of claim 1, wherein the fence comprises a member having an upper substantially horizontal portion and a lower substantially horizontal portion that are separated from each other by a space that is less than dimensions of the lock.

10. A display fixture comprising:
- a gondola including a base deck and a back panel supported by a pair of slotted uprights;
- a shelf mounted to the pair of slotted uprights;
- a cross support positioned under the shelf and mounted to the pair of slotted uprights;
- a fence coupled to a top of the shelf and positioned proximal to the front of the shelf; and
- a retractable tether coupled to a winder mechanism located inside an interior channel in the cross support, wherein the retractable tether extends from the winder mechanism through a slot in the cross support, extends between the back panel of the gondola and a back of the at least one shelf, couples to at least one product, and is secured to the fence at a distal end of the retractable tether with a lock so that the at least one product is secured to the shelf but is still allowed to be lifted and inspected by a customer.

11. The display fixture of claim 10, wherein the tether is coupled to the at least one product on the shelf by threading the tether through respective theft protection devices wrapped around each product on the shelf.

12. The display fixture of claim 10, further comprising a collar that is fixed to the retractable tether and a stop that encircles the retractable tether, wherein fixed collar engages with the stop so that the retractable tether protrudes from the winder mechanism for a length that corresponds with a distance between the fixed collar and the distal end of the retractable tether, wherein the minimum length is long enough to extend from the winder mechanism and around the back of the shelf.

13. The display fixture of claim 10, wherein the distal end of the tether is locked to the fence by engaging a key with the lock so that the lock grips an end piece located on the distal end of the tether.

14. The display fixture of claim 10, further comprising a plurality of winder mechanisms located inside the interior channel of the cross support, each winder mechanism including a retractable tether that extends from its associated winder mechanism and between the back panel of the gondola and the back of the shelf.

15. The display fixture of claim 10, wherein the lock has dimensions that are greater than a space between a pair of substantially horizontal portions of a member that comprises the fence so that to lock the distal end of the retractable tether to the fence includes threading the retractable tether through the space between the portions of the member and placing the lock on the distal end in front of the fence.

16. The display fixture of claim 10, further comprising a plurality of shelves mounted to the pair of slotted uprights of the gondola, each shelf having a cross support mounted a distance below each shelf and each cross support housing at least one winder mechanism having a retractable tether.

17. A method of securing product to a display fixture in a retail store, the method comprising:

pulling a retractable tether from a winder mechanism located inside a cross bar positioned below a shelf on a display fixture so that the retractable tether extends around a back of the shelf;

coupling the retractable tether to at least one product on the shelf;

coupling the retractable tether to a fence mounted to a top of the shelf and being located proximal to a front of the shelf; and locking a distal end of the retractable tether to the fence with a lock.

18. The method of claim 17, wherein coupling the retractable tether to the at least one product on the shelf comprises threading the retractable tether through a theft protection device wrapped around the at least one product on the shelf.

19. The method of claim 17, wherein the retractable tether protrudes from the winder mechanism for at least a minimum length using a collar fixed to the retractable tether that engages with a stop that surrounds the retractable tether, wherein the minimum length corresponds with a distance between the fixed collar on the retractable tether and the distal end of the retractable tether.

20. The method of claim 17, wherein locking the distal end of the retractable tether to the fence with the lock comprises gripping an end piece located on the distal end of the retractable tether by engaging a key with the lock.

* * * * *